United States Patent [19]

Wolze

[11] Patent Number: 4,727,297

[45] Date of Patent: Feb. 23, 1988

[54] ARC LAMP POWER SUPPLY

[75] Inventor: David A. Wolze, San Jose, Calif.

[73] Assignee: Peak Systems, Inc., Fremont, Calif.

[21] Appl. No.: 887,154

[22] Filed: Jul. 17, 1986

[51] Int. Cl.[4] ..... H05B 37/02

[52] U.S. Cl. ..... 315/307; 315/208; 315/209 R; 315/224; 315/241 R; 315/241 P; 315/DIG. 7

[58] Field of Search ..... 315/241 P, 241 R, 307, 315/DIG. 7, 224, 208, 209 R

[56] References Cited

U.S. PATENT DOCUMENTS

| | | | |
|---|---|---|---|
| 3,198,982 | 8/1965 | Benson et al. | 315/97 |
| 3,819,983 | 6/1974 | Bjork | 315/241 P |
| 4,100,462 | 7/1978 | McLellan | 315/179 |
| 4,253,048 | 2/1981 | Osako | 315/307 |
| 4,277,728 | 7/1981 | Stevens | 315/307 |
| 4,303,849 | 12/1981 | Goede et al. | 315/241 P |
| 4,327,309 | 4/1982 | Wallot | 315/170 |
| 4,337,418 | 6/1982 | Walz | 315/362 |
| 4,396,872 | 8/1983 | Nutter | 315/308 |
| 4,412,154 | 10/1983 | Klein | 315/307 |
| 4,415,839 | 11/1983 | Lesea | 315/308 |
| 4,437,043 | 3/1984 | Pitel | 315/308 |
| 4,438,370 | 3/1984 | Allington | 315/106 |
| 4,460,953 | 7/1984 | Fukushima et al. | 211/69.1 |
| 4,477,748 | 10/1984 | Grubbs | 315/306 |
| 4,492,899 | 1/1985 | Martin | 315/308 |
| 4,504,772 | 3/1985 | Matsuura et al. | 318/603 |
| 4,506,196 | 3/1985 | Bees | 314/241 R |
| 4,523,129 | 6/1985 | Pitel | 315/291 |
| 4,524,289 | 6/1985 | Hammond et al. | 307/110 |
| 4,555,655 | 11/1985 | Tanaka | 320/1 |
| 4,567,424 | 1/1986 | Dobsa et al. | 323/210 |
| 4,578,772 | 3/1986 | Fujii | 364/850 |
| 4,585,974 | 4/1986 | Stupp | 315/307 |
| 4,623,824 | 11/1986 | Scolari et al. | 315/307 |

*Primary Examiner*—Harold Dixon

*Attorney, Agent, or Firm*—Townsend & Townsend

[57] ABSTRACT

An improved high power (40,000 watt) high intensity arc discharge power supply which provides reliable, automatic ignition control and enables precise variation of lamp power in dual AC and DC modes of operation over an extended dynamic range from 400 watts to 40,000 watts. A capacitive boost circuit is provided to supply the high voltage necessary to ignite the lamp. Upon start-up, the voltage on a boost circuit capacitor is monitored by an ignition circuit which automatically enables the ignitor when the voltage is at the required level and switches the ignitor off when the lamp starts. After ignition the boost charging circuit is disabled and the power supply operates in a normal mode. The power supply operates on a three phase alternating voltage input through a three phase bridge, switches it through a drive transistor and then supplies it to an inductor. The signal is then supplied through an H-bridge commutator to the boost circuit, the ignitor and the arc lamp itself. The circuit operates under the control of an analog computer which determines the switching rate, monitors the voltage and current, provides power feedback and generally controls the power supply. A power command input signal determines the power level at which the arc lamp will operate. Below a certain lamp current level, an oscillator circuit controlling the commutator is disabled so the lamp will operate on DC power in a "simmer" or low temperature mode. The lamp is thus operated over a large dynamic range.

28 Claims, 11 Drawing Figures

30
BRIDGE
OUTPUT

OSCILLATOR
163
162

INTEGRATOR
165
164

COMPARATOR
AND MAIN
SWITCH
OUTPUT
167
166

INDUCTOR
OUTPUT
168

COMMUTATOR
OUTPUT
(AC)
170
(EXPANDED SCALE)

COMMUTATOR
OUTPUT
(DC)
172
(EXPANDED SCALE)

ARC LAMP POWER SUPPLY

BACKGROUND

The present invention relates to power supplies for high intensity arc discharge (HIAD) lamps and more specifically to circuits which integrate the complete operational control of such lamps over extended dynamic ranges.

The design of HIAD lamps involves many variables: arc length, bore diameter, electrode composition, fill gas, gas pressure, etc. Specific application and technological requirements will dictate which variables are selected for a given HIAD lamp, and thus establish its power and performance characteristics. Indeed, new industrial thermal and radiant processing technologies are emerging which require power supplies that can fully utilize the power and performance curves of state of the art HIAD lamps which may operate at power levels in excess of 40,000 watts.

As an example, one area in which precise, variable, high power lamp control is essential is that of thermal processing of semiconductor wafers. Most existing systems use an array of 10 or more filament lamps to heat such wafers. However, because of the large thermal mass of the filament lamps, they take a comparatively long time to heat wafers up to a given temperature. This poor response in shaping the wafer's time-temperature profile can lead to process problems. Additional process difficulties arise because an array of filament lamps is required to achieve the power levels necessary for high temperature processing. Each lamp may have slightly unique characteristics and may age differently, resulting in both process uniformity and reliability problems.

A single HIAD lamp can be used for thermal processing of semiconductor wafers and has the advantage of reaching temperature very quickly, thus providing more precise wafer time-temperature profiles. However, a power supply is required which can turn on a HIAD lamp with repeatable precision as well as vary lamp power quickly and accurately from an ultra-low power DC "simmer" mode (less than 400 watts) to a high power AC process mode (40,000 watts or more). The present invention incorporates these advantages and can address similar HIAD thermal and radiant processing requirements in other industries such as plastics, ceramics, and stage lighting to name a few.

An arc lamp is typically turned on by first charging a capacitive boost circuit and then starting the lamp with an igniter to provide a high voltage pulse across the electrodes. Typically, a timing circuit is used so that the igniter is switched on a predetermined amount of time after the boost capacitors start charging. This amount of time is estimated to be sufficient to provide the boost energy required. Often, several start attempts will be necessary in order to get a proper voltage pulse to start the lamp.

Once started, some embodiments then rectify AC line voltage to produce DC voltage which is then applied to a switching bridge to supply a pulsed voltage across the lamp. The bridge may be an SCR (Silicon Controlled Rectifier) switching bridge with an inductor in the bridge or in the circuit immediately after the bridge. The average voltage applied to the load is varied by controlling the pulse width with the bridge. Such a supply can only operate an arc lamp over a limited range because at low power the decreasing width of the pulse modulation causes the voltage to drop off to zero between pulses. This can cause the arc lamp to extinguish, and thus low power operation is not possible. AC operation is required for high power arc lamp operation in order to supply the large currents needed.

U.S. Pat. No. 4,412,156 to Ota discloses an AC power supply for a metal halide discharge lamp which includes a main switch, a commutator and power feedback. The circuit disclosed is designed for AC operation only at a fixed power level. Another AC power supply for a metal halide lamp is shown in U.S. Pat. No. 3,999,100 to Dendy et al. Here again, a fixed lamp power is used, and a power feedback error signal is used to control the switching to provide a constant power output.

A DC lamp power supply is shown in U.S. Pat. No. 4,240,009 to Paul. Again, power feedback is used to maintain a fixed power level. A capacitor is charged to provide the high voltage pulse needed to start the lamp, and circuitry is provided to repeat application of the pulse until the lamp starts. Another DC lamp power supply is shown in U.S. Pat. No. 4,399,392 to Buhrer.

Difficulties arise for a power supply when an arc lamp is operated over a wide range of power levels due to the characteristics of the arc lamp impedance. The power load line of a typical arc lamp (see FIG. 2) shows that at low power, a high voltage is required, with the voltage level dropping as the power increases. The voltage level decreases and levels off as power increases, then increases again at higher power levels, typically above 500 watts. In some applications, such as doing thermal processing of semiconductor wafers, a power supply is needed which can provide the power requirements of an arc lamp over a wide range of power levels.

SUMMARY OF THE INVENTION

The present invention is an improved, integrated high intensity arc discharge lamp power supply which provides reliable, automatic ignition control and enables precise variation of lamp power over an extended dynamic range. A capacitive boost circuit is provided to supply the high voltage necessary to ignite the lamp. Upon start-up, the voltage on a boost circuit capacitor is monitored by an ignition circuit which automatically enables the ignitor when the voltage is at the required level, and switches the ignitor off when the lamp starts.

After ignition the boost charging circuit is disabled and the power supply is connected to the lamp, and then operates in a normal mode. The power supply operates on a three phase alternating voltage input through a three phase bridge, switches it through a main switch transistor and then supplies it to an inductor. The signal is then supplied through an H-bridge commutator to the boost circuit, the ignitor and the arc lamp itself. The circuit operates under the control of an analog computer which determines the switching rate, monitors the voltage and current, provides power feedback and generally controls the power supply.

The main switch transistor is switched at a high frequency of approximately 2 kHz while the commutator is switched at a lower frequency. This allows for power level control using the higher 2 kHz frequency, which insures that the voltage will not decay to zero and extinguish the lamp at low power because of the high frequency of the pulses. The commutator, at its lower frequency, provides the AC signal needed for the high currents at high power lamp operation. The inductor, which is located between the drive transistor and the commutator, supplies the current needed by the arc lamp. By placing a commutator after the inductor, a square wave ballast is achievable to give very quick switching transitions and minimize flicker.

A power command input signal determines the power level at which the arc lamp will operate. Below a certain lamp current level, an oscillator circuit controlling the commutator is disabled so that the lamp will operate on DC power. The nature of the lamp load-line at low power and the use of snubbers (a resistor and a capacitor in series) cause the power supply to switch from an inductive supply mode at high power (when high current is needed) to a capacitive supply mode at low power (when high voltage is required). The power supply is thus able to operate over a large range of the power load line of the arc lamp. This is additionally made possible by the use of power feedback, which enables the power supply to distinguish between low and high power positions on the arc lamp load line which have identical voltages.

The power supply has many other additional features which enhance its operation. Snubbers are strategically placed within the power supply to allow reliable operation of the switching transistors. The boost capacitors are coupled in parallel with the lamp, thus insuring that the current drawn during ignition will be drawn solely from the capacitors and not from the rest of the power supply. The disabling of the commutator switching during the normal operating mode to provide DC operation is done randomly so that the electrodes of the lamp which operate as anode and cathode are randomly switched to even wear. In addition, the commutator switching is synchronized with the drive transistor so that voltage jumps each time the commutator switches are minimized.

The present invention has the object and advantage of providing a high intensity arc discharge lamp power supply with a large dynamic power control range. This is accomplished with dual AC/DC control and a novel closed loop power control loop.

A further advantage is the provision of flicker free operation, which is particularly important at low power.

A further advantage is the provision of high power AC operation, rather than relying on DC for high power as in the prior art.

A further advantage is the ability to quickly and precisely vary and control lamp power.

A further advantage is the ability to operate arc lamps from 60 V to 600 V from a 480 V, 3 phase balanced line.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
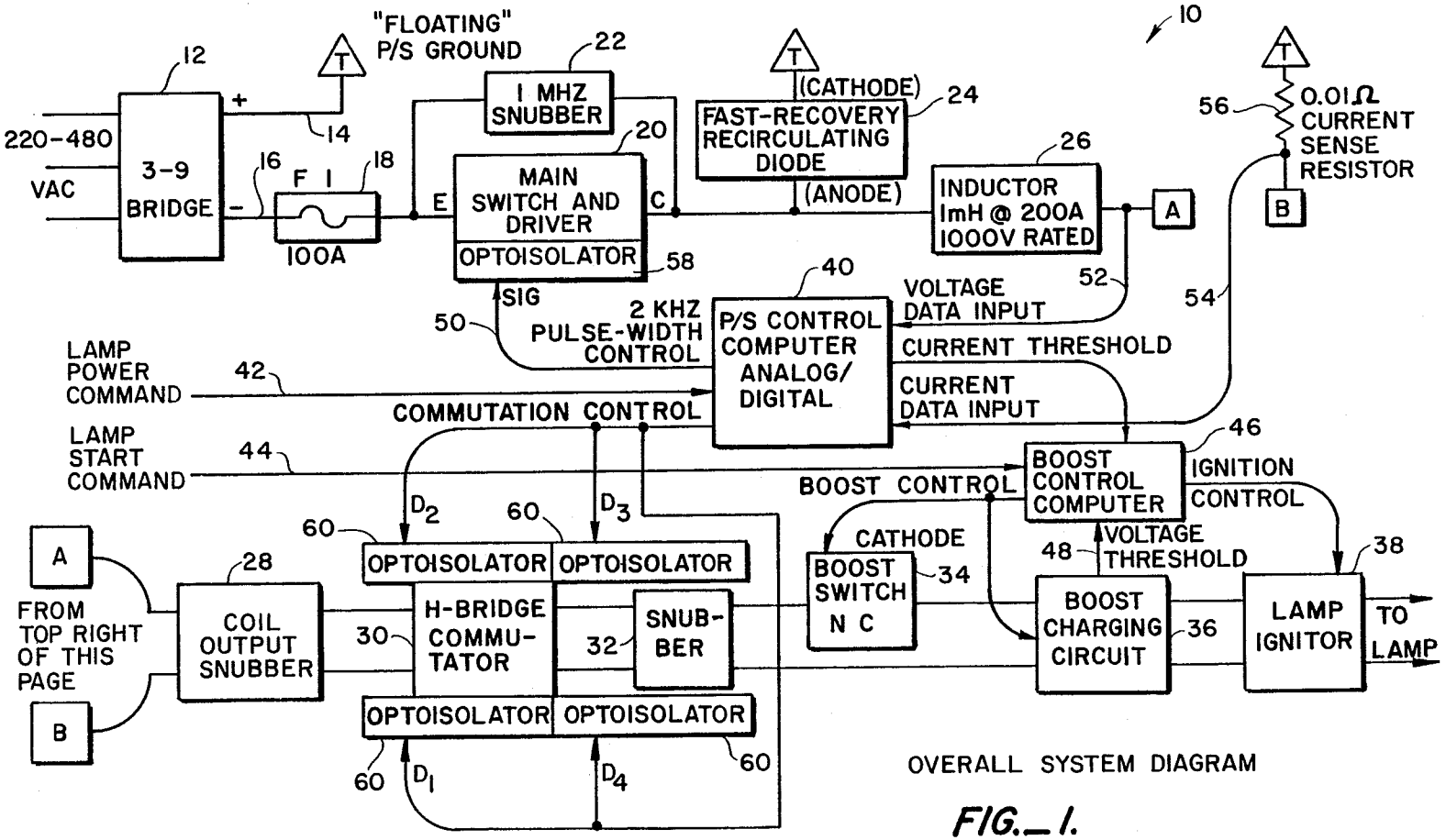
FIG. 1 is an overall block diagram of a preferred embodiment of a power supply according to the present invention.

FIG. 1 is a block diagram of a preferred embodiment of a power supply 10 according to the present invention. A three phase bridge 12 rectifies a three phase 220–480 volts AC signal and supplies the rectified signal across positive terminal 14 and negative terminal 16. Positive terminal 14 serves as a floating power supply ground. The signal on negative terminal 16 is supplied through a 100 amp fuse 18 to a main switch and driver circuit 20. A snubber circuit 22 (with a 1 megahertz (mHz) roll-off frequency) is provided in parallel with main switch and driver 20. The signal is then provided to a fast recovery recirculating diode 24 and an inductor 26.

The signal from inductor 26 is supplied through a snubber 28 to a commutator 30. The output of commutator 30 is supplied through a snubber 32 and a boost switch 34 to a boost charging circuit 36. The output of boost charging circuit 36 is supplied to a lamp ignitor circuit 38, the output of which is supplied to the arc lamp itself. The overall control of the power supply is done by a power supply analog computer 40.

The arrangement of main switch and driver 20, inductor 26 and H-bridge commutator 30 provides an inherently stable power supply. Due to differences in turn-on and turn-off times, all the transistors of H-bridge commutator 30 will be on for part of the time during switching. However, precise timing of the switching of the transistors in H-bridge commutator 30 is not required to prevent losses since inductor 26 prevents any instantaneous change in current. Inductor 26 maintains the current and thus voltage and power dissipation on switching is minimized. By putting inductor 26 before H-bridge commutator 30, the commutator is able to produce a square wave output to the lamp without having the transitions smoothed by the inductor. The inductor does smooth the transitions of the output of main switch and driver 20. Most of the losses at the high operating frequency of main switch and driver 20 are switching losses, and inductor 26 minimizes these losses.

In operation, to start the lamp a lamp power command is supplied on control line 42 and a lamp start command on control line 44. The power command on control line 42 determines the power level at which power supply 10 will operate. The start command on line 44 enables a boost control computer 46. Boost control computer 46 monitors the voltage level on boost charging circuit 36 through a voltage threshold supplied on line 48. When the capacitors in boost charging circuit 36 have been charged sufficiently, lamp ignite 38 is enabled by boost control computer 46. When the lamp is ignited, ignitor 38 is disabled and boost charging circuit 36 is removed from the circuit through the use of relays. This start-up sequence is described in more detail later with reference to FIGS. 3 and 4.

At this point, the power supply enters normal operation. The value of the power level, determined by the command on input line 42, is used to provide a 2 kilohertz (KHz) pulse width modulated control signal on a line 50 to main switch 20. Feedback is provided in the form of a voltage input signal on line 52 and a current input signal on line 54 from a current sense resistor 56. Thus, if the power signal derived from the voltage and current feedbacks indicates that the power level is too high, the on time of the 2 KHz pulse width control signal on line 50 will be decreased to lower the power level. The control signal on line 50 is provided through an optical isolator 58 so that large voltage swings through main switch and driver 20 do not couple back into control computer 40. Similarly, optical isolators 60 are provided on H-bridge commutator 30. These optical isolators eliminate any ground loops and transient problems which could get back to control computer 40.

Figure 2:
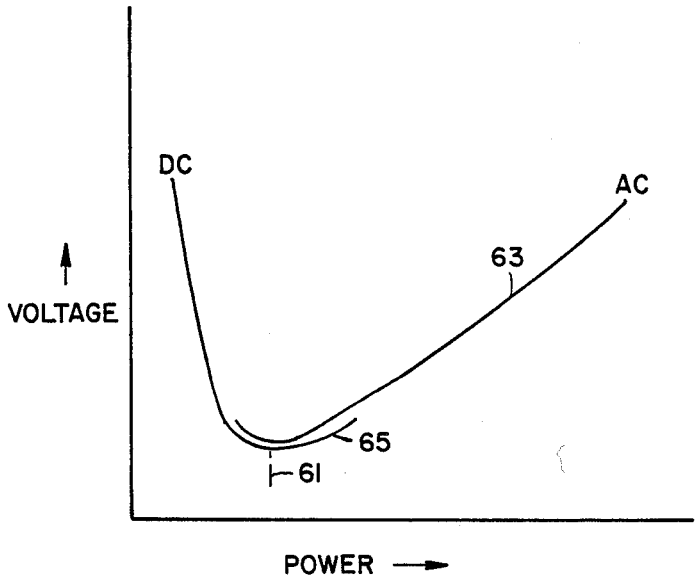
FIG. 2 is a graph of the arc lamp load lines for AC and DC operation.

FIG. 2 shows the AC and DC load lines for a typical 8" arc lamp. A high voltage is required at low power levels, with the voltage dropping until it reaches a knee of the curve at a power value 61 which typically corresponds to approximately 500 watts for a 8" arc lamp. The power levels below level 61 correspond to the line emission mode of the arc lamp in which colored light is emitted. The power levels above level 61 move into the normal "black body" mode in which white light is emitted. Most prior art arc lamps are operated in the black body mode. The voltage and current feedbacks on lines 52 and 54, respectively, (see FIG. 1) provide a power feedback that enables the power supply to determine where AC load line 63 or DC load line 65 of the power supply is operating. If only a voltage feedback was used, the power supply would not know which side of level 61 it should be operating on.

At high power levels, AC operation of the lamp prevents the high currents from overheating the lamp electrodes. At low power, the diameter of the lamp plasma decreases, thus decreasing the thermal time constant. AC operation is thus not practical at low power because the lamp would extinguish during switching because the thermal time constant is too small to maintain the arc during switching. Accordingly, at low power the power supply is preferably operated in the DC mode.

Returning now to FIG. 1, snubber 22 is provided to protect main switch transistor 20 from transients on line 16. Snubber 22 is chosen to have a roll-off frequency (frequency below which signals are unfiltered) of approximately one megahertz. Recirculating diode 24 maintains a current flow through inductor 26 when switch 20 is off. Recirculating diode 24 has a fast recovery or turn-off time (on the order of 500 nanoseconds) so that no voltage spikes from diode 24 can find their way to driver 20. Inductor 26 is a 2 millihenry (mH) inductor rated at 200 amps and 1,000 volts. The value of the inductance was chosen to operate in conjunction with an arc lamp having a resistive impedance of approximately 3 ohms (at high power). This gives an inductor impedance approximately 10 times the lamp impedance so that main switch 20 sees primarily inductor 26 rather than the lamp load in the average operating range.

Figure 3:
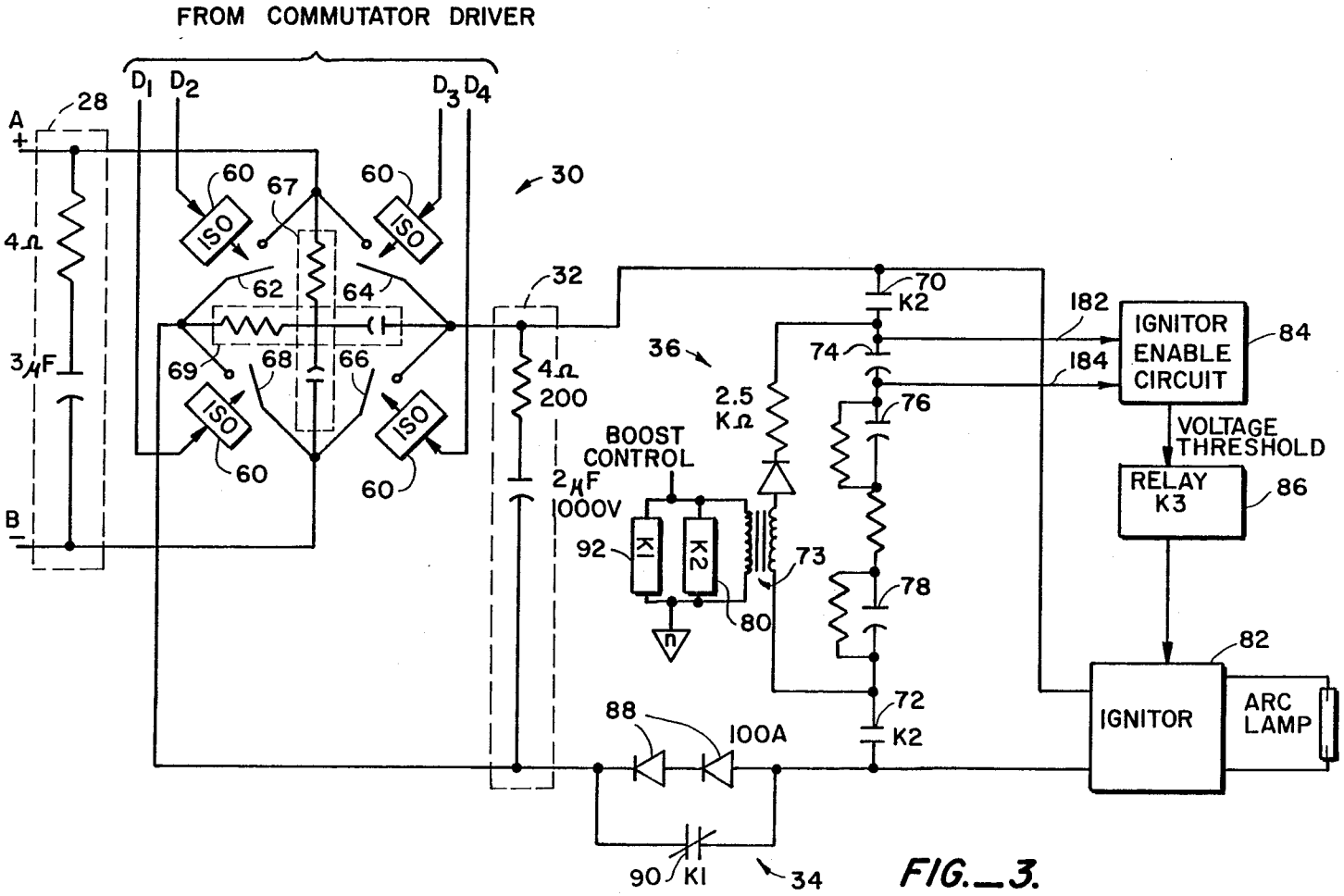
FIG. 3 is a schematic diagram of the commutator and boost circuit of the embodiment of FIG. 1.
Figures 6A, 6B, 6C, 6D, 6E, 6F, 6G:
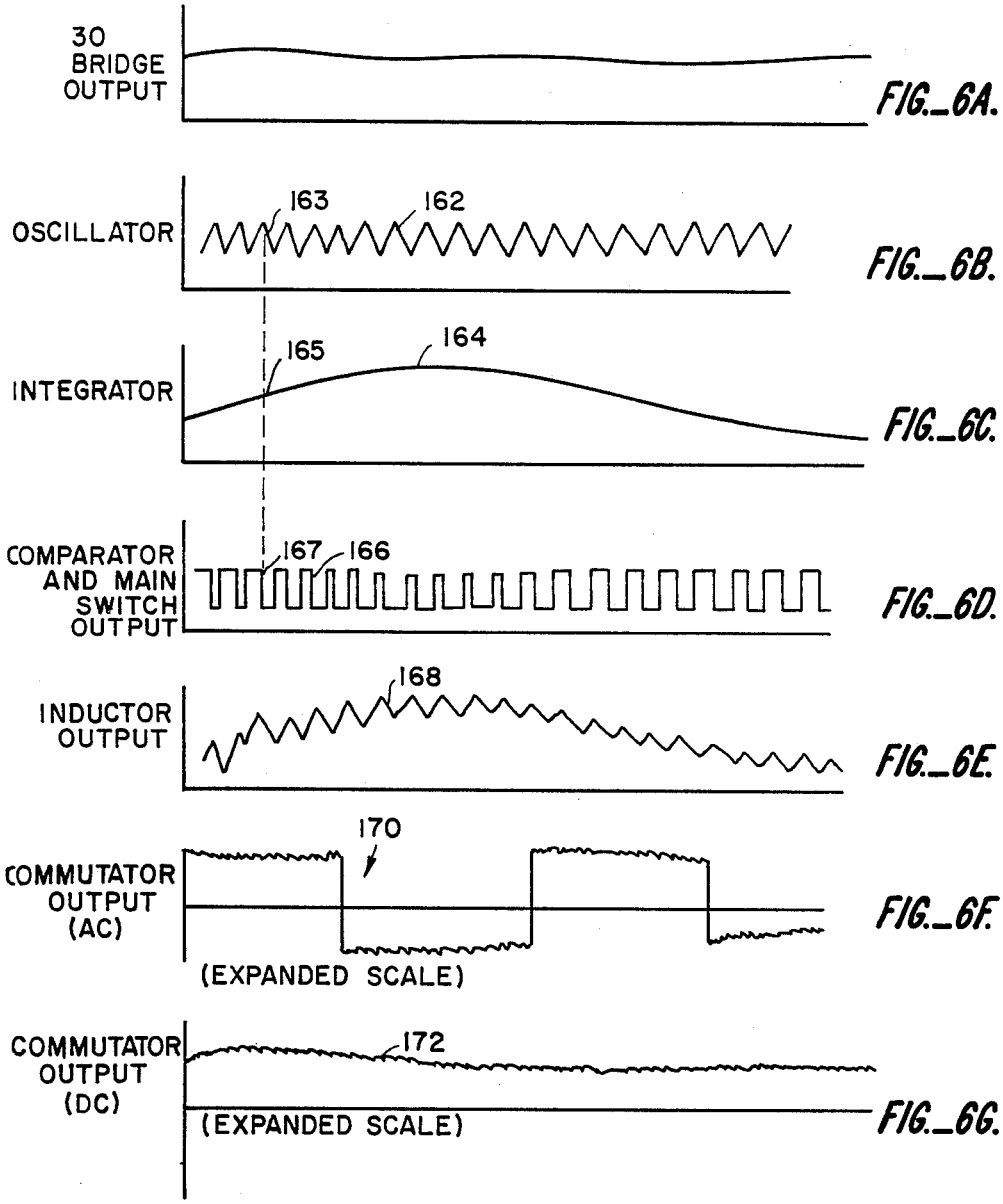
FIG. 6 is a schematic diagram showing the waveforms of the switching signals in the power supply of FIG. 1.

Coil output snubber 28 is provided to protect H-bridge commutator 30 from spikes on the triangular wave signal from inductor 26 (see FIG. 6). Snubber 28 is set for approximately a 15 kilohertz roll-off frequency, having a 4 ohm resistor and a 5 microfarad capacitor. A snubber 32 is provided to protect commutator 30 from RF (radio frequency) transients caused by the boost start and ignition circuitry consisting of boost switch 34, boost charging circuit 36 and ignitor 38. Snubber 32 has a higher roll-off frequency than snubber 28 and uses a 2 microfarad capacitor and 4 ohm resistor. There are also a pair of snubbers in H-bridge commutator 30 as shown in FIG. 3. Snubbers 28 and 32 also facilitate low power operation of the lamp by storing power between the on times of main switch 20. The power supply can thus operate as a capacitive power supply at low power (rather than as an inductive power supply as at high power).

FIG. 3 is a schematic diagram of the commutator and boost charging portions of the circuit of FIG. 1. During normal operation after start-up, an input signal applied across snubber 28 is provided to H-bridge commutator 30. A series of control signals D1-D4 are provided to optical isolators 60 which control a series of transistor switches 62, 64, 66 and 68. The transistor switches are controlled so that switches 62 and 66 are operated in phase, with switches 64 and 68 being opened and closed in opposite phase to switches 62 and 66. A pair of snubbers 67, 69 are provided across H-bridge commutator 30, each having a roll-off frequency of approximately 0.5 mHz. The output of commutator 30 is applied through snubber 32 to lamp 94. During normal operation after start-up, the output signal is isolated through relay contacts 70, 72 from the boost charging circuitry.

The boost charging circuitry provides a 115 volt AC BOOST CONTROL signal to a step-up transformer 73 which is coupled to three boost capacitors 74, 76 and 78. Relay contacts 70, 72 are controlled by a relay coil 80, which in turn is controlled by the BOOST CONTROL signal from control computer 40.

Figure 4:
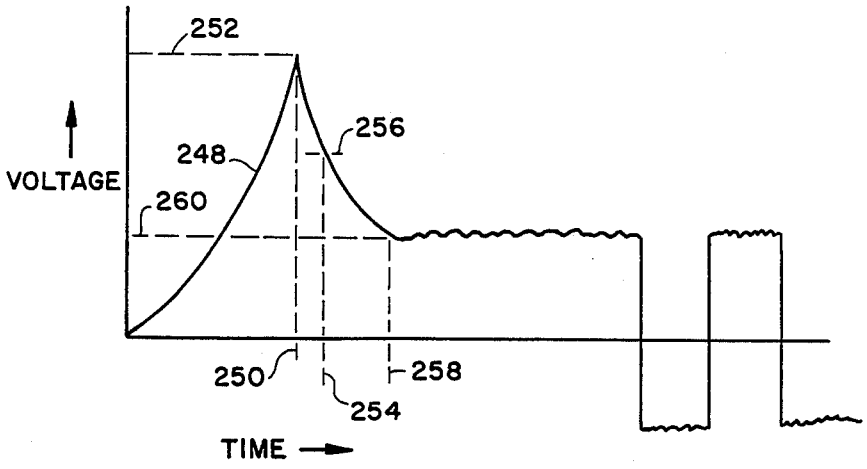
FIG. 4 is a graph of the voltage levels during start-up of the power supply of FIG. 1.

The starting of the lamp can be be understood with reference to the voltage graph of FIG. 4. On start-up, a DC voltage is applied to capacitors 74, 76 and 78 by closing relay contacts 70 and 72 (see FIG. 3). The specific mechanism for supplying this start-up signal is discussed later. The primary of transformer 73 receives a 115 volts AC BOOST CONTROL signal (which is also applied to relay coils 80, 92) and the stepped-up signal on the secondary of the transformer is rectified and supplied to capacitors 74, 76 and 78. The capacitors charge up as shown by line 248 of FIG. 4 to a level 252 at a time 250. While capacitors 74, 76 and 78 are charging, diodes 88 isolates the high boost voltage across these capacitors from the rest of the power supply. A relay contact 90 is held in an open position by coil 92 under control of the BOOST CONTROL signal during this time so that diodes 88 are not bypassed.

Ignitor enable circuit 84 monitors the voltage across capacitor 74, which is proportional to the total voltage across all the boost charging capacitors. When a level proportional to level 252 is detected, relay 86 is activated to enable ignitor 82. Level 252 is the voltage threshold level at which ignitor 82 will fire the arc lamp with an ignition spark, and varies depending upon the particular arc lamp. Typically, this value is in the range of 1200–1500 volts. The time 250 required to charge the capacitors is typically approximately 10 seconds.

After ignitor 82 is enabled at time 250, the capacitors are discharged until the voltage reaches a level 256 at a time 254. At this point, ignitor 82 is disabled by ignitor enable circuit 84, which senses the drop in voltage across capacitor 74. The lamp continues to run off the stored charge in the boost capacitors 74, 76, 78, and the voltage across the capacitors continues to drop until it is equal to the voltage on the output terminals of the lamp power supply (the voltage across snubber 32). When this happens, diodes 88, which are wired across relay contact 90, start to conduct. Once diodes 88 start conducting, a current sensor in control computer 40 of FIG. 1 (described in more detail later) detects the current that has begun to flow through the power supply. A 12 volt DC signal is sent to Boost Control Computer 46, which removes the BOOST CONTROL signal, disabling coils 80 and 92 and the primary of transformer 73. The disabling of coil 92 closes contact 90, bypassing diodes 88 and allowing AC operation. Up to this time, only DC operation was possible. The disabling of coil 80 causes the boost circuitry to be isolated by the opening of relay contacts 70 and 72.

After a short delay provided by control computer 40 (typically 200–300 milliseconds) until a time 258, the power supply enters its normal operation mode. The 200–300 millisecond delay provides time for the relays to settle down before commencing normal operation. This is shown as the AC mode in FIG. 4 corresponding to a voltage level 260 which is selected as the operating voltage. Alternately, if a lower operating voltage is selected, the power supply may operate in a DC mode. If the current drops below a preset value of approximately 2 amps (indicating lamp failure) a main contactor for the power supply is disabled by control computer 40, as discussed later.

For AC operation, transistor switches 62, 66 and 64, 68 alternate being on and off. For DC operation, either transistors 62, 66 are open and transistors 64, 68 are closed or vice versa. The selection of which switches are open or closed is done randomly so that the electrodes of arc lamp 94 alternately operate as a cathode or anode. This insures even wear of the electrodes and extends the lamp's life. During low power DC operation, the 2 microfarad capacitor of snubber 32 and the 5 microfarad capacitor of snubber 28 store the high voltage needed by the lamp. This high voltage is needed because the lamp impedance increases from approximately 3 ohms at high power to 50 or even 100 ohms at low power. With the inductive impedance at 20 ohms at the 2 KHz switching frequency, the ratio between the inductive impedance and the lamp impedance will drop below unity as the power drops and power supply 10 will shift from being an inductive circuit to being a capacitive circuit. This allows the lamp to run at low power.

Figure 5:
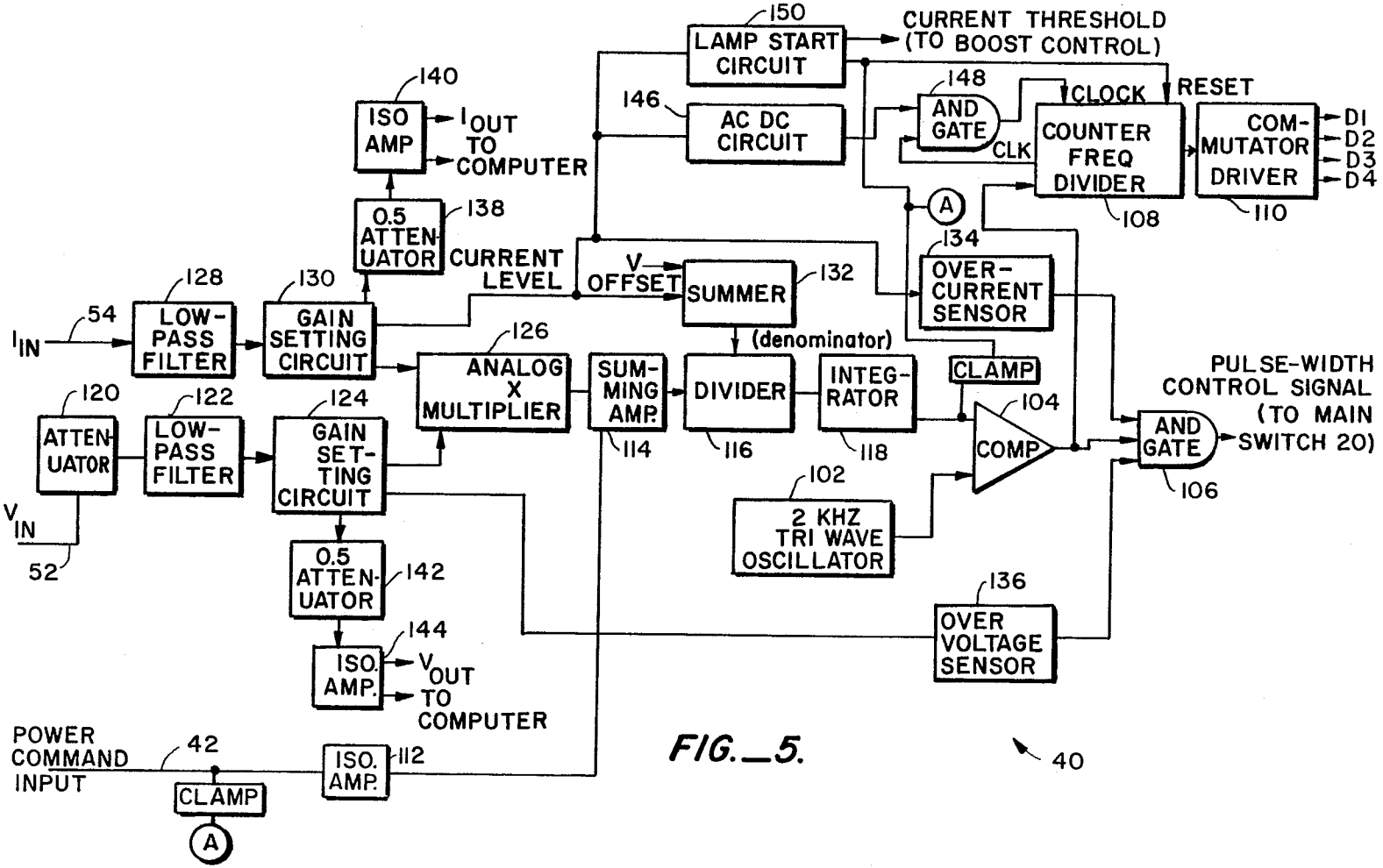
FIG. 5 is a block diagram of the power supply analog computer of FIG. 1.

FIG. 5 is a block diagram of the power supply control computer 40 of FIG. 1. The switching waveform is generated by a 2 KHz tri-wave oscillator 102. The signal from oscillator 102 is supplied through a comparator 104 and an AND gate 106 to main switch 20 of FIG. 1. The signal from comparator 104 is also supplied through a frequency divider 108 and a commutator driver 110 to provide control signals D1–D4 to commutator 30 as shown in FIG. 2. Frequency divider 108 provides a commutator switching frequency 32 times less than the main switching frequency provided to main switch 20.

The power level is set by a power command input on line 42 through an isolation amplifier 112 to a summing amplifier 114. The signal is supplied through a divider circuit 116 and an integrator 118 to a second input of comparator 104. Thus, this level determines, in conjunction with oscillator 102, the amount of time the pulse width control signal for switch 20 will be on.

Frequency divider 108 (a ripple counter) is set up to clock on the 0–1 transitions of main switch 20. By tying the commutator switching to the main switch transitions, synchronization is insured to cause the commutating switching to occur at low voltage values, thus minimizing voltage spikes on commutator switching.

Power feedback is provided by a current signal on line 54 and a voltage signal on line 52. Line 52 is supplied to an attenuator 120, a low pass filter 122 and a gain setting circuit 124 to an analog multiplier 126. Similarly, the current signal 54 is supplied to a low pass filter 128 and a gain setting circuit 130 to analog multiplier 126. This feedback signal is combined with the power command input signal in summing amplifier 114 to set the pulse width control signal. Filter 128 is a 4th order Chebyshev filter and attenuator 120 in combination with filter 122 forms a 5th order Chebyshev filter. Attenuator 120 is provided first to handle the large voltage values.

Divider circuit 116 is included to provide a constant gain response. This allows an increase in the bandwidth of operation of the power supply at low power. The power supply feedback controls the duty cycle to produce the desired average voltage, while the feedback is in the form of power, or current times voltage. Accordingly, divider 116 provides a current feedforward value in the denominator of the transfer equation to cancel out the current value in the power feedback in the numerator and thus provide a constant gain response. Changes in gain are needed to compensate for changes in the power level and changes in the lamp resistance (which is a function of the power level). The current value is obtained from gain setting circuit 130 and is supplied to a summer 132 where it is added to a voltage offset (so that there is no divide by 0 in a 0 current situation). The output of summer 132 is supplied as the denominator to divider 116. This division by a current value does not simply cancel out the multiplication by a current value in multiplier 126 because of the intervening power command input supplied to summing amplifier 114. This input must be in the form of a power command because of the nature of the lamp load line as shown in FIG. 2.

Divider 116 and current summing amplifier 114 together form a gain linerization circuit, which holds the system gain to a fixed value, regardless of lamp impedance or power level. The output of this gain linearization circuit also has a DC value of zero. Integrator 118 provides an infinite gain at DC, which eliminates any offsets. Also, the integrator gain rolls off at a steady 6 dB/octave as the frequency increases, and thus attenuates any high frequency instabilities that may occur.

Control computer 40 is essentially a type 1 servo, which means that it has one integrator in the loop. The feedback signal is derived both from the current and voltage supplied to the lamp through multiplier 126, and therefore the servo is a power servo. The use of power rather than current or voltage alone for feedback linearizes the overall process temperature control system and increases its bandwidth and stability. The use of a 2 KHz switching frequency in conjunction with the fast acting transistors of commutator 30 provide a high frequency square wave power supply. Due to the square wave type transitions, there is no lamp flicker. This is because the dead time in the lamp is less than 10 microseconds, which is less than the thermal time constant of the plasma in the lamp. Thus, the lamp plasma stays on and stays stable. The use of power feedback and gain linearization enables control computer 40 to operate power supply 10 for the arc lamp over a large dynamic range. For instance, the lamp could be operated from as low as 300 watts up to 30 kilowatts, which is a factor of 100:1, or a range of approximately 40 dB.

Control computer 40 also has an overcurrent sensor 134 and an overvoltage sensor 136 which provide additional inputs to AND gate 106 to disable switch 20 in the event of an overcurrent or overvoltage condition. The value of the current and the voltage can be supplied to an external digital host computer through an attenuator 138, an isolation amplifier 140 and an attenuator 142 and an isolation amplifier 144, respectively.

A lamp start current sensor 150 senses an initial current value after the lamp has started and normal operation commences. Sensor 150 resets frequency divider 108 so that the commutator signals D1–D4 will provide connections with the same polarity voltage as the voltage applied by the boost capacitors during start-up. Current sensor 15 (described in more detail later with reference to FIG. 11) is provided with delay to keep commutator 30 from switching until the relays isolating the boost charging circuitry have settled. The power supply always operates in a DC mode during this start-up delay.

Also shown in FIG. 5 is a clamping circuit 135 coupled to an input to comparator 104 and a clamping circuit 137 coupled to power command input 42. Both clamping circuits are controlled by lamp start circuit 150 and are activated when the lamp start circuit provides the reset signal to frequency divider 108 to limit the power on start-up. Clamping circuit 137 clamps the power command input to a value less than the value provided by clamping circuit 135, which provides a value limiting the main switch to a maximum 25% duty cycle.

AC/DC current sensor 146 determines whether the power supply will operate in the AC or DC mode during normal operation. At approximately 7 amps, AC/DC current sensor circuit 146 provides a signal to AND gate 148 which enables the last stage of frequency divider 108 as shown in more detail in FIGS. 9 and 10. The AC/DC switch-over is provided with approximately 2 amps of hysteresis since AC and DC operation of the arc lamp have different load lines as shown in FIG. 2. Counter 108 will thus not begin switching commutator 30 until at least 7 amps of DC current have been applied. Up to this value, DC operation occurs.

Turning now to FIG. 6, there is shown a diagram of the switching waveforms in the operation of the circuit of FIG. 1. A signal 160 with a 360 Hz ripple appears across terminal 16, 14 at the output of three phase bridge 12. The output of tri-wave oscillator 102 is shown as signal 162. This signal is compared with an output signal 164 from integrator 118 to produce a comparator signal 166 at the output of comparator 104.

The power feedback signal (error signal) and the desired power level are represented by integrator output signal 166. When this value becomes too high, it intersects oscillator signal 162 at a higher point, causing a low transition on comparator output signal 166. This low value on comparator output signal 166 turns off switch 20, causing the power signal to decrease. This can be seen, for example, in FIG. 4 at a point in time where oscillator signal 162 is at a value 163 which is lower than a value 165 of integrator signal 164, causing comparator 166 to make a low transition 167.

Signal 166 is used to produce both the pulse control signal for main switch 20 and the commutator switching signals. Signal 168 shows the shape given to the signal from switch 20 after passing through inductor 26. The output of the commutator showing switching during AC operation is shown as signal 170. The scale is expanded relative to the previous waveforms so that the switching can be seen. As can be seen, the transitions due to commutator switching on signal 170 occur at the low points of signal 168 to minimize voltage spikes. In addition, it can be seen that the frequency of the commutator switching is 32 times less than the main switching frequency due to the use of frequency divider 108. A signal 172 shows the DC output signal when frequency divider 108 is disabled. Signal 172 can be either positive or negative, depending upon the state of frequency divider 108 when it is disabled.

Figure 7:
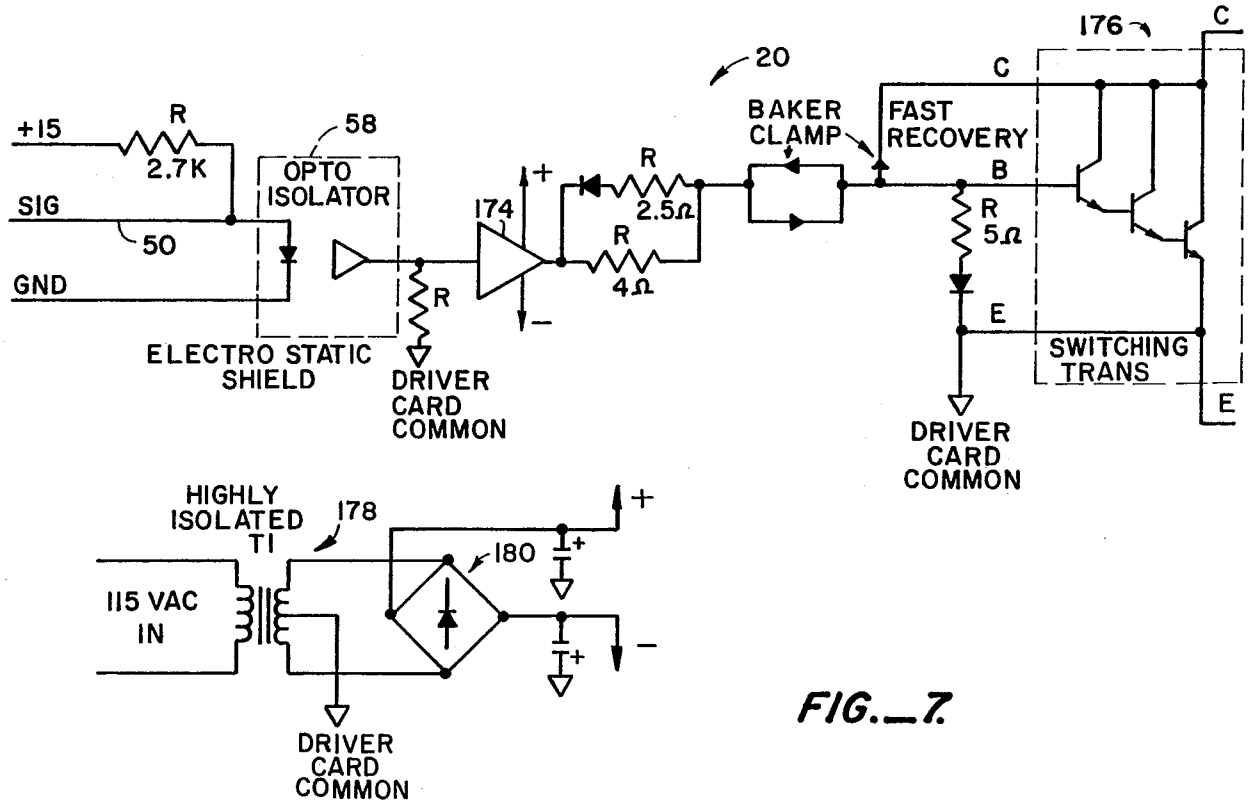
FIG. 7 is a schematic diagram of the main switch and driver of FIG. 1.

FIG. 7 shows the main switch and driver 20 of FIG. 1 in more detail. The pulse width control signal is supplied on line 50 to an optical isolator 58. The output of optical isolator 58 is applied through an amplifier 174 and other circuitry to the power switching transistors 176. The power to amplifier 174 is supplied through a highly isolated transformer 178 and a diode bridge 180. Drive circuit 20 is designed similar to a video amplifier with a rise time in the order of nanoseconds. All of the transistors operate in their linear range without saturation. This provides for rapid rise time and minimization of delays. This precise timing is necessary in order to prevent voltage spikes which could destroy commutator 30.

Figure 8:
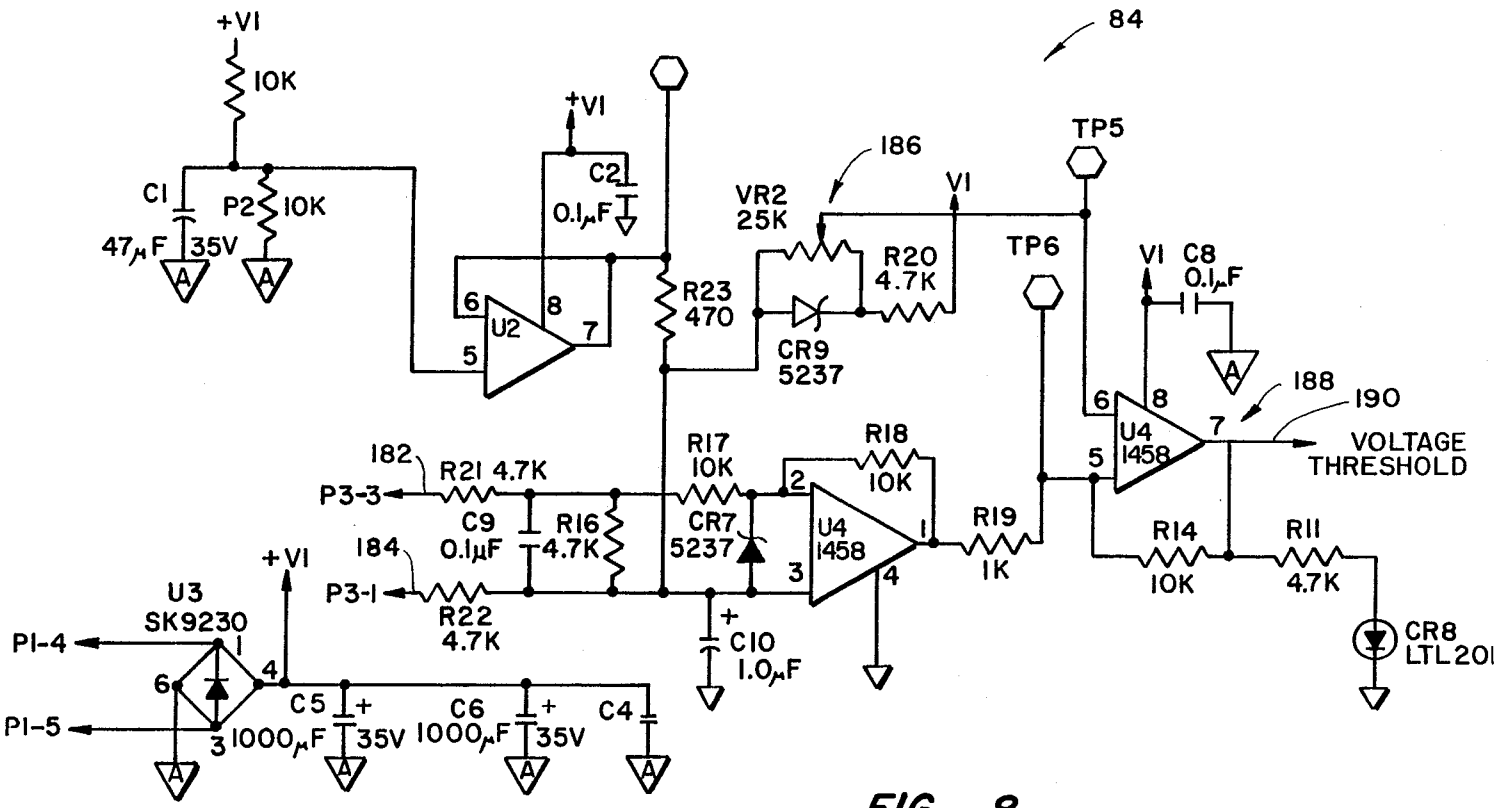
FIG. 8 is a schematic diagram of the ignitor enable circuit of FIG. 3.

FIG. 8 is a schematic diagram of the ignitor enable circuit 84 of FIG. 2. A pair of input lines 182, 184 provide the voltage from across capacitor 74 of FIG. 2. The voltage reference level is set by a potentiometer 186 which is fed as one input to a comparator 188. When the detected voltage exceeds the voltage reference, an output is provided on line 190 to an ignitor relay.

Figure 9:
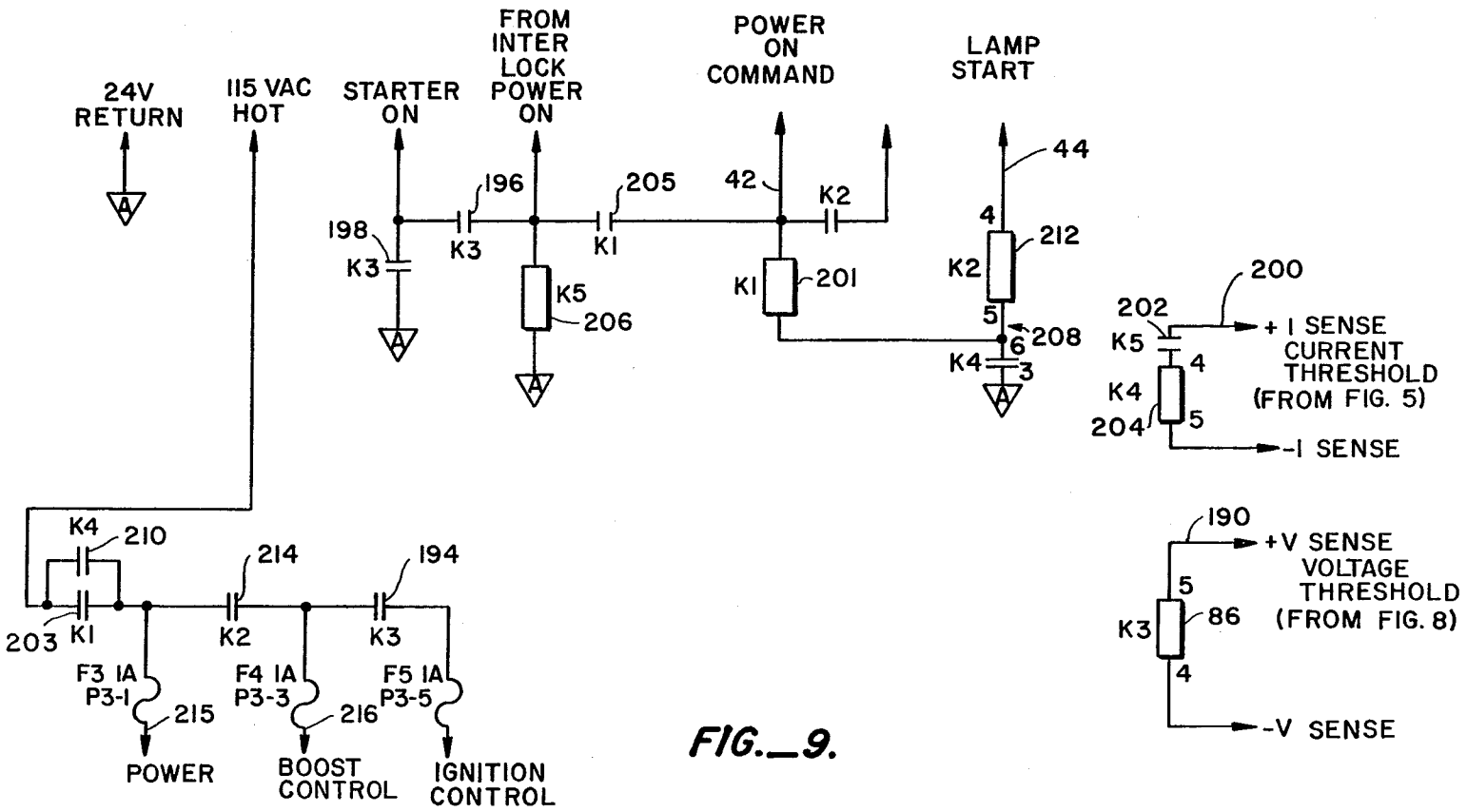
FIG. 9 is a schematic diagram of the boost control computer of FIG. 1.

FIG. 9 shows the various relays used in boost control computer 46 of FIG. 1. All of the relays are latching relays which are energized by a pulse command. The power-on command on line 42 (see FIG. 1 also) energizes a coil 201 (since a relay contact 208 is normally closed). Coil 206 is always held on by the power-on interlock, closing contact 202. Energized coil 201 closes contacts 203 and 205. A lamp start command on line 44 energizes coil 212, closing contact 214 to provide the BOOST CONTROL signal to start charging the boost capacitors as shown in FIG. 3. When ignitor enable circuit 84 of FIGS. 3 and 8 detects sufficient voltage, a voltage threshold signal is supplied on line 190 through relay 86 to close contact 194. This provides an ignition control signal to ignitor 82 of FIG. 3.

When the voltage threshold level drops below a set value upon the discharging of the boost capacitors to ignite the lamp, coil 86 will stop conducting and contacts 194 will open, disabling ignitor 82 by removing the IGNITION CONTROL signal. The boost capacitors will continue to discharge until the voltage across the capacitors is equal to the output voltage across snubber 32, causing diodes 88 to conduct (see FIG. 3).

When lamp start current sensor 150 of FIG. 5 detects sufficient current, it provides a current threshold signal on line 200 which energizes coil 204 and opens contact 208 to de-energize coils 201, 212, while closing contact 210 to take over control of providing power to the power contactor.

If the current threshold drops below a specified minimum level of 3 amps, coil 204 will stop conducting thereby opening contacts 210 to remove the power from the power contactor for the power supply.

Figure 10:
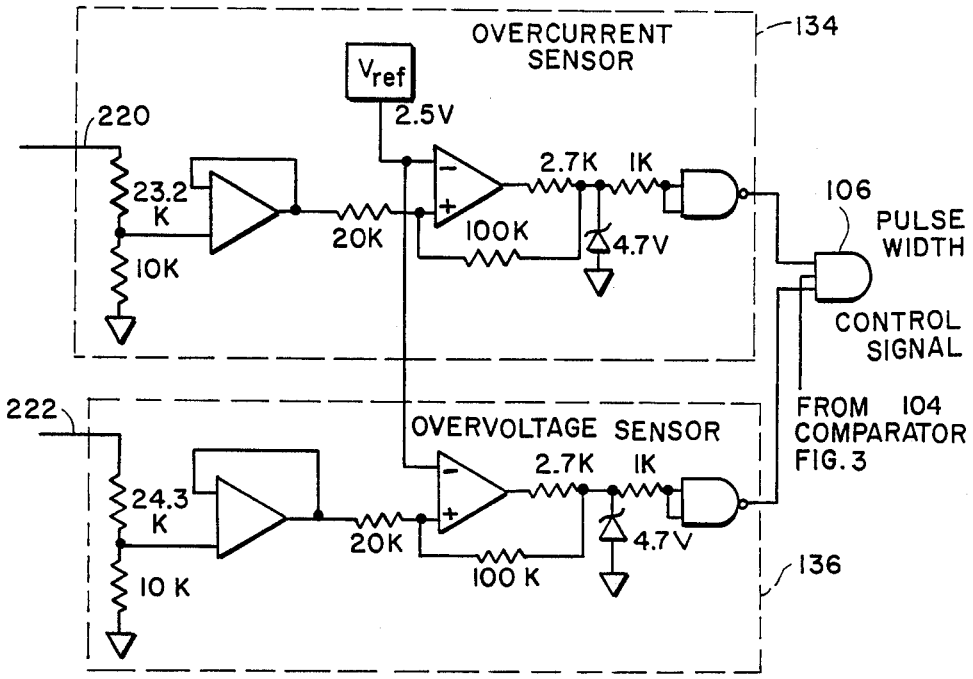
FIG. 10 is a schematic diagram of the over-current and over-voltage circuits of FIG. 5.

FIG. 10 shows an overcurrent sensor 134 and overvoltage sensor 136. The outputs of both of these circuits feed into AND gate 106 to provide a disabling signal in the event of an overvoltage or overcurrent condition. Overcurrent sensor circuit 134 will disable main switch 20 if the current exceeds 125 amps and is provided with 50 amps of hysteresis. Overvoltage sensor circuit 136 will provide a disabling output upon the detection of a voltage of greater than 600 volts, and is provided with 200 volts of hysteresis. As can be seen by reference to FIG. 3, input line 220 to overcurrent sensor 134 originates from gain setting circuit 130 and input line 222 to overvoltage circuit 136 originates from gain setting circuit 124.

Figure 11:
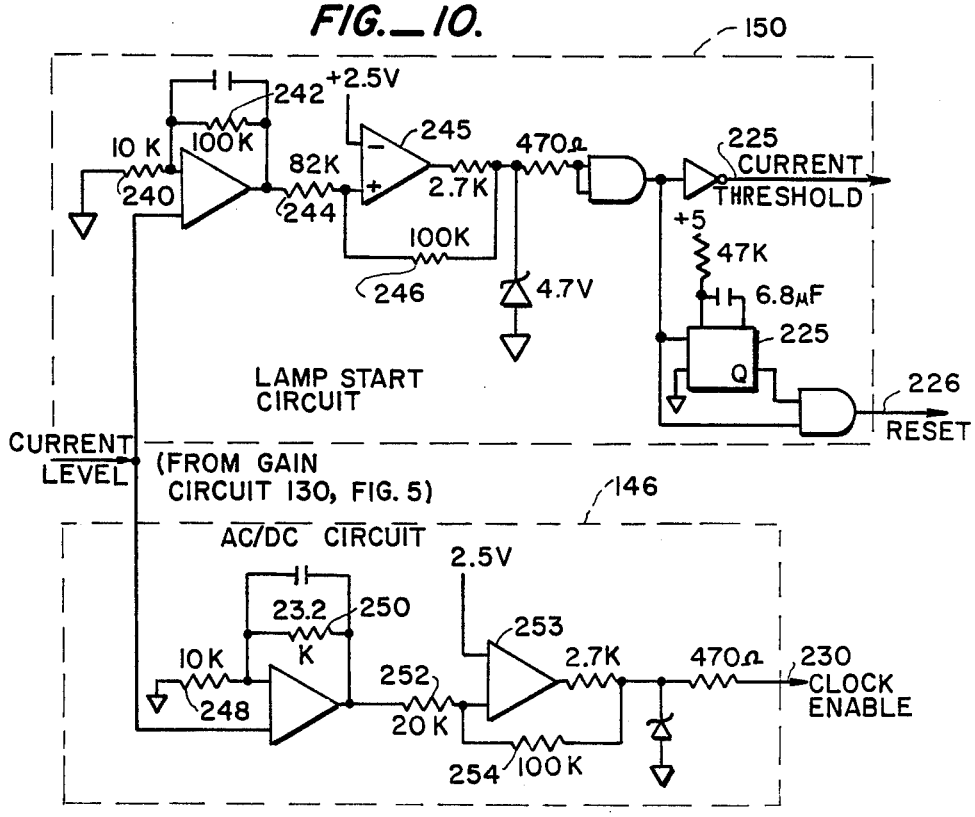
FIG. 11 is a schematic diagram of the lamp start and AC/DC circuits of FIG. 5.
Figure 12:
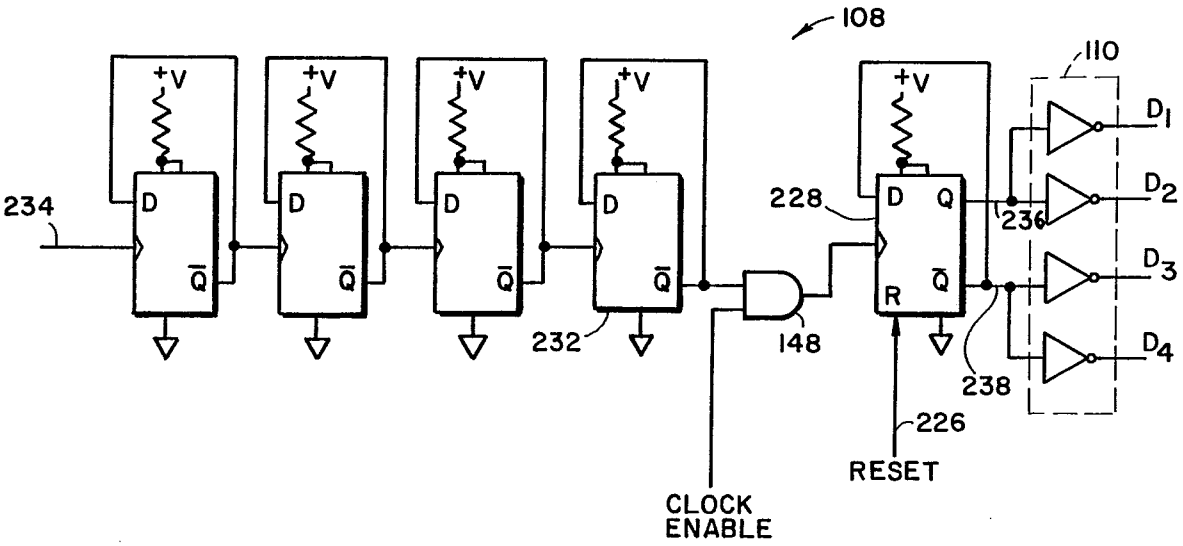
FIG. 12 is a schematic diagram of the commutator frequency divider of FIG. 5.

FIG. 11 shows a schematic diagram of lamp start current sensor 150 and AC/DC current sensor 146. A single input 224 is provided to both circuits from an ammeter in gain setting circuit 130 of FIG. 3. Resistors 240 and 242 set the point at which current is sensed for lamp start circuit 150. When 7 amps of current is sensed, the CURRENT THRESHOLD signal is provided to the boost control computer 46 of FIG. 9, which provides the BOOST CONTROL signal to relay coil 92 of FIG. 3, opening contact 90 and removing the AC current sensed by gain circuit 130 of FIG. 5. After the ignition and boost stages of start-up, when contact 90 closes and AC current is again detected, lamp start circuit 150 provides a RESET signal on line 226 to the last stage of frequency divider 108 as shown in FIG. 12. Latch 225 provides a 200–300 millisecond delay, which is the period from times 254–258 of FIG. 4. The delay allows time for the relays to settle before normal operation of the power supply.

Lamp start circuit 150 is provided with hysteresis by comparator 245 and resistors 244, 246. This hysteresis causes the CURRENT THRESHOLD signal to go on at 7 amps and go off at 3 amps. Thus, if the power supply falls below 3 amps it is disabled by the boost control computer of FIG. 9 in response to the CURRENT THRESHOLD signal.

Output 230 of AC/DC circuit 146 is provided as one input to an AND gate 148 as shown in FIG. 10. The other input to AND gate 148 is the inverted output of second-to-last stage 232 of frequency divider 108 of FIG. 10. The output of AND gate 148 is coupled to the clock input of last stage 228. When the current level is above approximately 8 amps, AND gate 148 is enabled by clock enable signal 230 and AC operation commences.

AC/DC circuit 146 also stops AC operation when the current falls below 6 amps. The 2 amps of hysteresis is set by comparator 253 and resistors 252, 254. The initial AC turn-on level of 8 amps is set by resistors 248, 250. This hysteresis is required due to the difference in the AC and DC load lines of the lamp as shown in FIG. 2. The hysteresis of AC/DC circuit 146 is within the hysteresis of lamp start circuit 150 so the power supply can switch from AC to DC operation without turning the power supply off.

Turning now to FIG. 12, frequency divider 108 is a five-stage, edge-triggered ripple counter. Input 234 to frequency divider 108 originates from comparator 104 as shown in FIG. 5. Outputs 236 and 238 each drive two drivers of commutator driver 110. When AND gate 148 is enabled, the last stage 228 will alternate output levels, causing commutator driver 110 to switch the commutator giving AC operation.

As will be understood by those familiar with the art, the present invention may be embodied in other specific forms without departing from the spirit or essential characteristics thereof. For example, commutator 30 could be built with SCRs rather than transistors, or other variations in the specific circuitry could be implemented. For instance, the multiplying and dividing and other functions of the analog computer could be done using digital signal processing. Accordingly, the disclosure of the preferred embodiment in the invention is intended to be illustrative, but not limiting, of the scope of the invention which is set forth in the following claims.

What is claimed is:

1. A power supply for an arc lamp comprising:

means for rectifying an AC line signal to produce a rectified signal;

switching means, coupled to said rectifying means, for switching said rectified signal to produce a pulsed signal;

an inductor coupled in series with said switching means to produce a smoothed signal from said rectified signal;

a commutator, coupled to said inductor, for switching said smoothed signal to produce an AC signal;

ignition means for applying a voltage pulse to said arc lamp;

capacitive boost means for supplying a voltage to said ignition means;

boost charging means, coupled to an output of said commutator, for charging said capacitive boost means;

sequencing means for comparing a capacitive voltage on said capacitive boost means to a reference voltage and enabling said ignition means when said capacitive voltage exceeds said reference voltage;

oscillator means for controlling the switching of said commutator; and means for monitoring one of a current and a voltage supplied to said arc lamp and disabling said oscillator means when one of said arc lamp voltage and arc lamp current falls below a predetermined value so that said lamp operates with a DC signal.

2. A power supply for an arc lamp, comprising:

ignition means for applying a voltage pulse to said arc lamp;

capacitive boost means for supply a voltage to said ignition means;

boost charging means for charging said capacitive boost means; and sequencing means for comparing a capacitive voltage on said capacitive boost means to a reference voltage and enabling said ignition means when said capacitive voltage exceeds said reference voltage, said sequencing means further including means for disabling said ignitiion means after said enabling when said capacitive voltage fails below a predetermined second reference voltage.

3. A power supply for an arc lamp, comprising:
ignition means for applying a voltage pulse to said arc lamp;
capacitive boost means for supplying a voltage to said ignition means;
boost charging means for charging said capacitive boost means;
sequencing means for comparing a capacitive voltage on said capacitive boost means to a reference voltage and enabling said ignition means when said capacitive voltage exceeds said reference voltage;
a three-phase bridge for producing a rectified signal from a three-phase input signal;
means for switching said rectified signal;
an inductor having an input coupled to an output of said switching means;
a commutator having an input coupled to an output of said inductor and an output coupled to said boost charging means and said lamp; and
a computer for controlling the switching of said switching means and said commutator.

4. The power supply of claim 3 further comprising:
a diode coupled between said commutator and said boost charging means;
means for sensing a current through said commutator and producing an output signal when said current is above a predetermined level; and
means, responsive to said output signal, for isolating said capacitive boost means from said arc lamp and commutator and bypassing said diode.

5. The power supply of claim 4 wherein said means for isolating comprises a relay having a pair of relay contacts coupling said capacitive boost means across said arc lamp and said commutator.

6. The power supply of claim 3 further comprising a series combination of a resistor and a capacitor across the input to said commutator.

7. The power supply of claim 3 further comprising a series combination of a resistor and a capacitor across the output of said commutator.

8. The power supply of claim 3 wherein said computer includes an oscillator coupled to control the switching of said driver and switching means and a frequency divider, coupled to said oscillator and coupled to control the switching of said commutator.

9. The power supply of claim 8 wherein said computer further includes a comparator having a first input coupled to an output of said oscillator and an amplifier having an input for a desired power level signal, an output coupled to a second input of said comparator, an output of said comparator being coupled to said driver and switching means and to said frequency divider.

10. The power supply of claim 9 wherein said computer further includes:
means for sensing a power supply current;
means for sensing a power supply voltage;
multiplier means for multiplying outputs of said current sensing means and said voltage sensing means to produce a power feedback signal;
means for summing said power feedback signal with said power level signal in said amplifier; and
means for integrating an output of said amplifier, an output of said integrating means being coupled to a second input of said comparator.

11. A power supply comprising:
means for rectifying an AC line signal to produce a rectified signal;
switching means, coupled to said rectifying means, for switching said rectified signal to produce a pulsed signal;
an inductor coupled in series with said switching means to produce a smoothed signal from said rectified signal;
a commutator, coupled to said inductor, for switching said smoothed signal to produce an AC signal; and
a computer for controlling the switching of said switching means and said commutator in synchronization.

12. The power supply of claim 11 further comprising a series combination of a resistor and a capacitor across an output of said commutator.

13. The power supply of claim 11 further comprising a series combination of a resistor and a capacitor across an input of said commutator.

14. The power supply of claim 11 further comprising a pair of series combinations of a resistor and a capacitor coupled across opposite corners of said commutator.

15. The power supply of claim 11 wherein said commutator is an H-bridge commutator comprising four commutator transistors for switching said smoothed signal.

16. The power supply of claim 15 further comprising four optical isolators, each of said optical isolators being coupled to a base of one of said commutator transistors.

17. The power supply of claim 11 wherein said computer includes an oscillator coupled to control the switching of said switching means and a frequency divider, coupled to said oscillator and coupled to control the switching of said commutator.

18. The power supply of claim 17 wherein said computer further includes:
a comparator having a first input coupled to an output of said oscillator;
a summing amplifier having a first input for a desired power level signal, an output coupled to a second input of said comparator, an output of said comparator being coupled to said switching means and to said frequency divider;
means for sensing a power supply current;
means for sensing a power supply voltage;
multiplier means for multiplying outputs of said current sensing means and said voltage sensing means to produce a power feedback signal, said power feedback signal being applied to a second input of said summing amplifier; and
means for integrating an output of said summing amplifier, an output of said integrating means being coupled to a second input of said comparator.

19. The power supply of claim 18 further comprising means, coupled between an output of said summing amplifier and an input of said integrating means, for dividing said output of said summing amplifier by a value proportional to said power supply current.

20. The power supply of claim 11 further comprising a fast recovery, recirculating diode coupled to an output of said switching means.

21. A power supply for an arc lamp, capable of automatically switching between AC and DC operation, comprising:
driver means for switching an input voltage to produce a drive signal for said lamp;
an inductor coupled to said driver means to produce a smoothed DC drive signal;

a commutator for switching said DC drive signal to alternately invert and not invert said DC drive signal to produce an AC drive signal;

oscillator means for controlling the switching of said commutator; and means for monitoring one of a current and a voltage supplied to said arc lamp and disabling said oscillator means when one of said arc lamp voltage and arc lamp current falls below a predetermined value so that said DC drive signal is passed through said commutator, without switching, to said lamp.

22. The power supply of claim 21 wherein said means for monitoring and disabling is operable to randomly alternate disabling said oscillator at different switching configurations of said commutator so that said commutator alternately inverts said DC drive signal or does not invert said DC drive signal each time the DC drive signal is used.

23. The power supply of claim 21 wherein said oscillator means includes an oscillator coupled to a multiple stage frequency divider, said means for disabling said oscillator means comprising means for disabling a clock input to one of said stages.

24. A power supply for an arc lamp capable of quickly switching between a large range of power levels, comprising:

means for rectifying an AC line signal to produce a rectified signal;

switching means, coupled to said rectifying means, for switching said rectified signal to produce a pulsed signal;

an inductor coupled in series with said switching means to produce a smoothed signal to said arc lamp;

digital computer means for providing a power command input signal; and analog computer means for monitoring the power applied to said lamp to generate a power feedback signal and combining said feedback signal with said power command input signal to provide a control signal to said switching means for controlling the pulse width of the pulses signal.

25. The power supply of claim 24 wherein said analog computer means further comprises means for dividing said control signal by a current level signal proportional to the current through said arc lamp.

26. The power supply of claim 24 wherein said switching means comprises a switching transistor and said control signal is provided to the base of said switching transistor.

27. The power supply of claim 24 further comprising a commutator coupled between said inductor and said arc lamp, said commutator being controlled by said analog computer means to provide AC power to said arc lamp for high power levels.

28. The power supply of claim 27 wherein said analog computer means further comprises an oscillator and means for combining an output of said oscillator with said control signal to provide a common frequency signal for said switching means and said commutator.

* * * * *